United States Patent [19]

Stockman

[11] 4,166,496

[45] Sep. 4, 1979

[54] STATIC SEAL

[75] Inventor: Richard F. Stockman, Friendship, N.Y.

[73] Assignee: The Air Preheater Company, Inc., Wellsville, N.Y.

[21] Appl. No.: 934,752

[22] Filed: Aug. 21, 1978

[51] Int. Cl.[2] ..... F28D 19/00
[52] U.S. Cl. ..... 165/9; 277/56
[58] Field of Search ..... 165/9; 277/56

[56] References Cited

U.S. PATENT DOCUMENTS

| | | | |
|---|---|---|---|
| 2,744,731 | 5/1956 | Brandt | 165/9 |
| 2,873,952 | 2/1959 | Mudersbach et al. | 165/9 |
| 2,945,681 | 7/1960 | Burchfield | 165/9 |

*Primary Examiner*—Albert W. Davis, Jr.
*Attorney, Agent, or Firm*—Wayne H. Lang

[57] ABSTRACT

A sealing arrangement positioned between a sector plate and an adjacent connecting plate at the end of a rotary regenerative heat exchanger adapted to utilize normal pressure differential of a fluid being contained to create a force that acts upon the sealing arrangement to effect an improved sealing relationship.

5 Claims, 3 Drawing Figures

STATIC SEAL

BACKGROUND OF THE INVENTION

The present invention relates to rotary regenerative heat exchange apparatus including a rotor in which a plurality of compartments containing a mass of heat absorbent material extend radially outward from a central rotor post. The rotor is rotated about its axis between ducts for a hot and cold fluid to subject the heat absorbent material to the flow of the hot and cold fluids flowing therethrough whereby the rotor will absorb heat from the hot fluid, and upon rotation, transfer the heat to the cooler fluid passing therethrough.

As the hot and cool fluids pass through the rotor of the heat exchanger, they are maintained in their separate ducts by apertured sector plates that confront the end edges of the rotor in a sealing relationship. Inasmuch as the rotor is subjected to wide variations of temperature, arrangements have been devised whereby the sector plates are adapted to expand or contract whereby a constant sealing relationship may be maintained in the manner shown by U.S. Pat. No. 3,010,707, U.S. Pat. No. 3,786,868, and U.S. Pat. No. 4,040,475. In these patents the sector plate is adapted to move axially. However, there is no attempt to maintain a sealing relationship between the relatively movable sector plate and the connecting plate of the housing that lies adjacent thereto.

SUMMARY OF THE INVENTION

This invention therefore provides a static sealing arrangement that is positioned between the sector plate and the adjacent connecting plate of a heat exchanger to permit independent movement of the sector plate while precluding leakage of fluid thereby. A conventional radial seal is also affixed to an end of the rotor and adapted to rub against the adjacent face of the sector plate to preclude the direct flow of fluid between opposite sides thereof. More specifically, this invention provides an arrangement whereby a static seal between a sector plate and a connecting plate is continuously placed under a bias by a differential of pressure that is naturally available between the several fluids being contained.

DESCRIPTION OF THE PREFERRED EMBODIMENT

Figure 1:
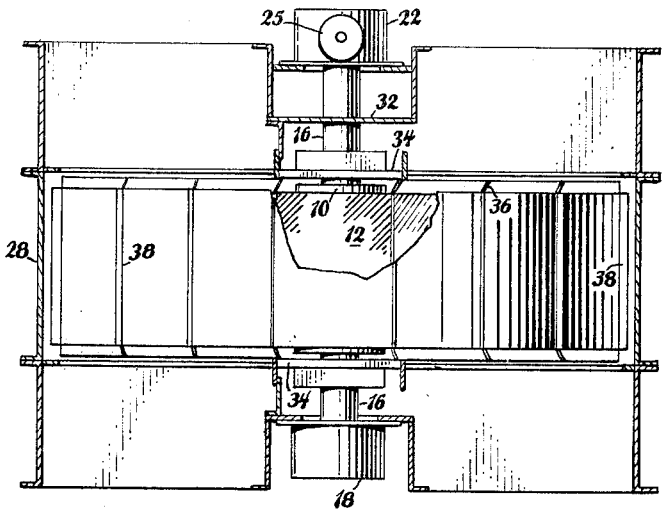
FIG. 1 is a cross-section of a rotary regenerative heat exchange apparatus embodying the present invention.
Figure 2:
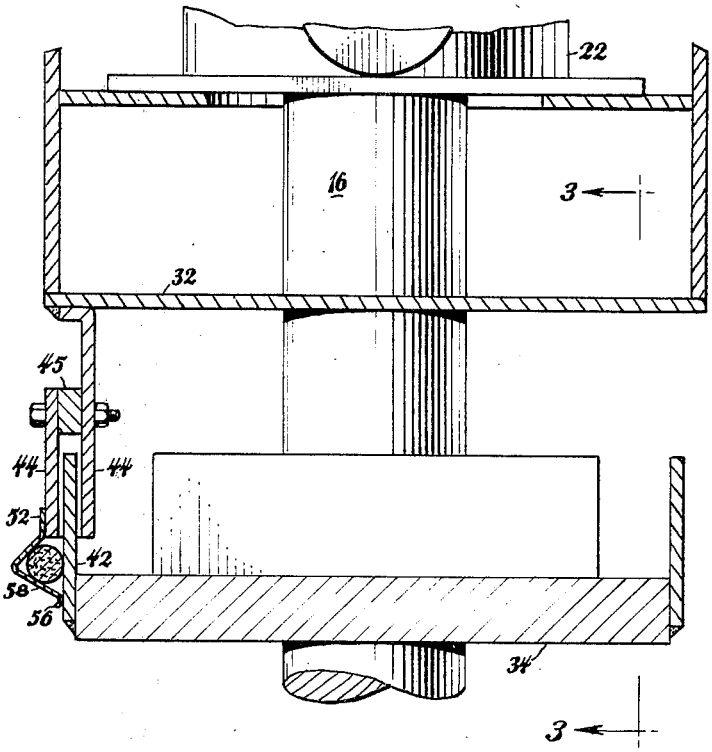
FIG. 2 is an enlarged cross-section of the apparatus as seen from line 2—2.
Figure 3:
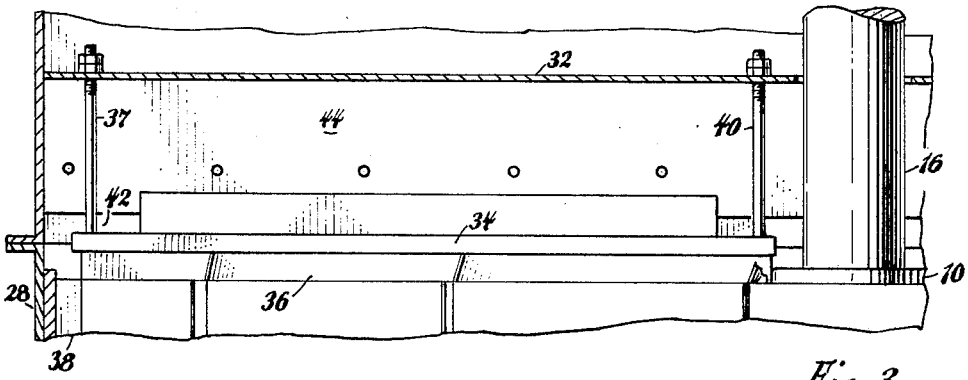
FIG. 3 is a cross-section of the drawing as seen 90° from that shown in FIG. 2.

In the drawings a cylindrical rotor formed concentrically around a central rotor post 10 rotates a mass of heat absorbent material 12 between a cool fluid and a relatively hot fluid. The rotor post 10 includes a trunnion means 16 at opposite ends thereof supported by a thrust bearing 18 at one end and by a guide bearing 22 at the other. The rotor is turned about its axis by any convenient driving means such as motor 25.

The rotor is surrounded by a rotor housing 28 that includes end or connecting plates 32 at opposite ends thereof between apertures that permit the hot and cool fluids to flow independently through the heat absorbent material of the rotor.

To prevent the intermingling of said fluids as they pass through the heat exchanger, sector plates 34 are provided at the ends of the rotor housing and adapted to lie in sealing relation with the radial seals 36 that are carried by the adjacent end of the rotor. The sector plates are supported at their outboard ends on hangers 37 or the like that lie at the ends of the rotor normal to the axial seals 38 around the peripheral edge of the rotor. The inboard end of each sector plate lies adjacent the rotor and is supported on a mount 40 that moves axially in accordance with axial expansion of the rotor, while the outboard end of a sector plate is forced to assume a position that agrees with thermal distortion of the adjacent rotor.

Thus the sector plate is in continuous contact with variable temperatures and must therefore be adapted to move axially in accordance with thermal distortion of the rotor. However, the adjacent connecting plate is not in continuous contact with variable temperatures since it is carried by the housing in substantially fixed relation to the sector plate. To permit relative movement therebetween, an axially disposed sealing strip 42 extends radially from a face of the sector plate between two similar plates 44 that are affixed to the adjacent face of connecting plate 32 and held apart by a shim 45 to effect a telescopic action that permits the sector plate to move axially relative to the connecting plate while precluding substantially all fluid leakage thereby.

The telescopic arrangement reduces fluid flow between opposite sides of the sector plate, however some fluid leakage thereby does continue to occur in retarded manner thereby lowering the overall effectiveness of the arrangement. To substantially stop all fluid leakage, a continuous strip 52 of spring steel is then connected to an end of the outer elongate telescopic member 44. The strip 52 is longitudinally formed to include an elongate bight that terminates in a reversely curved edge 56 that rubs against the side face of the oppositely movable telescopic strip 42 affixed to the sector plate. Although the edge 56 is disposed so that it presses against the side face of adjacent strip 42, some fluid may flow past the end of the seal to the opposite side of the strip 52 because of any minute imperfections in the sealing surface.

To substantially preclude all fluid flow past the seal means 42–44, a pliable elongate packing 58 is inserted in the bight whereby high pressure fluid leaking through the passageways of the seal will tend to move the pliable packing toward the low pressure area, across the restriction formed between the vertical section 42 and the sealing strip 52. A sealing plate or barrier 58 at each end of the sealing strip 52 is bonded along its edge to the strip 42 and thus adapted to lie closely adjacent the end of the formed sealing strip 52 to preclude excess leakage of fluid therefrom.

The elongate bight of strip 52 may assume any of various configurations, so long as the packing 58 therein is made to fit into the space available. Thus the pressure differential will act upon it to effect a closure of any leakage path for fluid between the strip 52 and the adjacent face of strip 42.

I claim:

1. Rotary regenerative heat exchange apparatus including a cylindrical rotor containing a mass of heat absorbent material disposed for rotation about a central rotor post, a housing surrounding the rotor including connecting plates at opposite ends of the rotor having passageways that direct the flow of a low pressure heating fluid and the flow of a high pressure cooling fluid through the heat absorbent material carried by the rotor, bearing means adapted to support the rotor for rotation about its axis, sector plates intermediate an end of the rotor and the connecting plates of the rotor housing adapted to separate the low pressure fluid from the high pressure fluid, a first radial sealing means at the end of the rotor adapted to run against the sector plates to preclude the flow of fluid therebetween, a second radial sealing means extending radially between the connecting plate and the sector plate including a first elongate strip connected to a radially disposed edge of the connecting plate, a second elongate strip connected to the connecting plate adapted to lie spaced from the first elongate strip to provide an elongate gap therebetween, an elongate sealing member connected to a radially disposed edge of the sector plate and arranged to extend into the elongate gap between the first and second elongate strips to form a telescopic seal, and an elongate leaf spring arranged to bridge the space between relatively movable members.

2. Rotary regenerative heat exchange apparatus as defined in claim 1 wherein the elongate leaf spring is longitudinally formed to include an elongate bight portion between parallel plane portions that are adapted to lie adjacent relatively movable parts of the telescopic sealing means.

3. Rotary regenerative heat exchange apparatus as defined in claim 2 including a pliable packing member carried in the bight portion of the longitudinally disposed leaf spring that is forced continuously by the high pressure fluid to close a gap between relatively movable parts of the telescopic seal.

4. Rotary regenerative heat exchange apparatus as defined in claim 3 wherein the pliable packing member is of cylindrical configuration that is deformed by the pressure differential between the high and low pressure fluids.

5. Rotary regenerative heat exchange apparatus as defined in claim 4 wherein the cylindrical packing material comprises a heat resistant material that withstands temperatures in excess of 600° F.

* * * * *